United States Patent [19]

Snyder

[11] 4,096,457

[45] Jun. 20, 1978

[54] LOW PASS HARMONIC ABSORBER

[75] Inventor: Richard V. Snyder, Lincroft, N.J.

[73] Assignee: Harvard Industries, Inc., Farmingdale, N.J.

[21] Appl. No.: 737,092

[22] Filed: Oct. 29, 1976

[51] Int. Cl.[2] ..... H01P 1/20; H01P 1/26; H01P 5/12

[52] U.S. Cl. ..... 333/73 W; 333/22 R; 333/81 B

[58] Field of Search ..... 333/73 R, 73 W, 73 C, 333/98 R, 81 B, 95 R, 22 R, 22 F, 33

[56] References Cited

U.S. PATENT DOCUMENTS

| | | | |
|---|---|---|---|
| 2,590,511 | 3/1952 | Craig et al. | 333/95 R X |
| 3,187,277 | 6/1965 | Wantuch | 333/73 W |
| 3,353,123 | 11/1967 | Met | 333/73 W |
| 3,593,220 | 7/1971 | Rooney | 333/81 B X |

OTHER PUBLICATIONS

Lance–"Introduction to Microwave Theory and Measurements", McGraw Hill, New York 1964; title page & pp. 96–97.

*Primary Examiner*—Alfred E. Smith
*Assistant Examiner*—Marvin Nussbaum
*Attorney, Agent, or Firm*—Frailey & Ratner

[57] ABSTRACT

A microwave low pass harmonic absorber having a main waveguide which passes a desired fundamental frequency. A plurality of shunt waveguides are disposed on the walls of the main waveguide for providing an absorptive path for the harmonic energy. Each of the shunt waveguides includes at least one ridge for lowering the cutoff frequency of the shunt waveguide. In another embodiment, the shunt waveguides include two ridges disposed opposite each other.

9 Claims, 7 Drawing Figures

FIG. 1
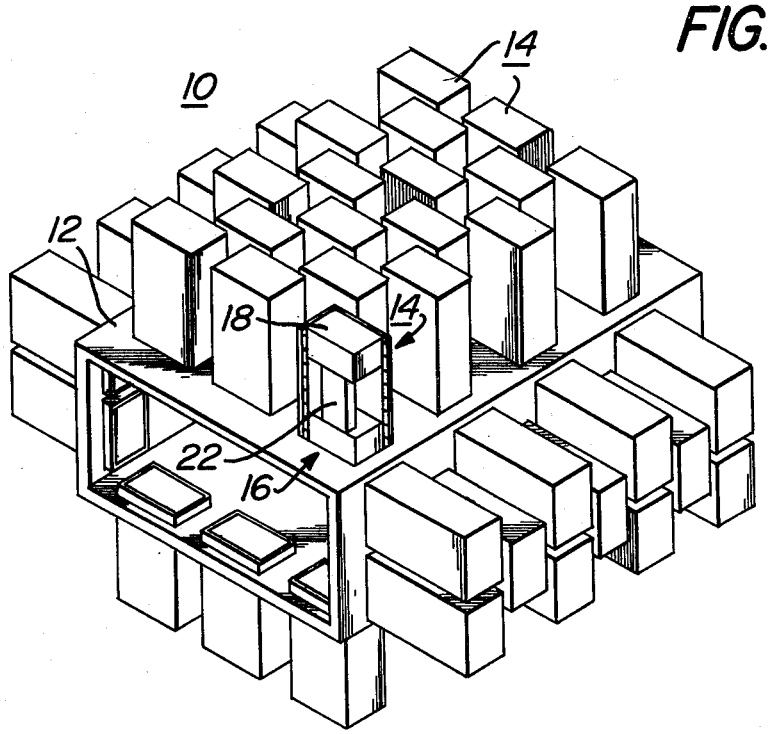
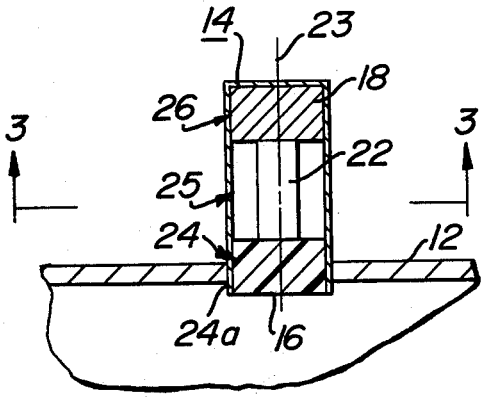
FIG. 2
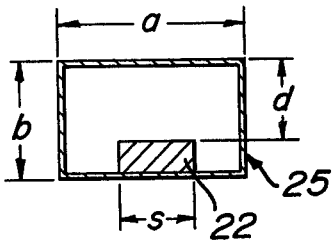
FIG. 3

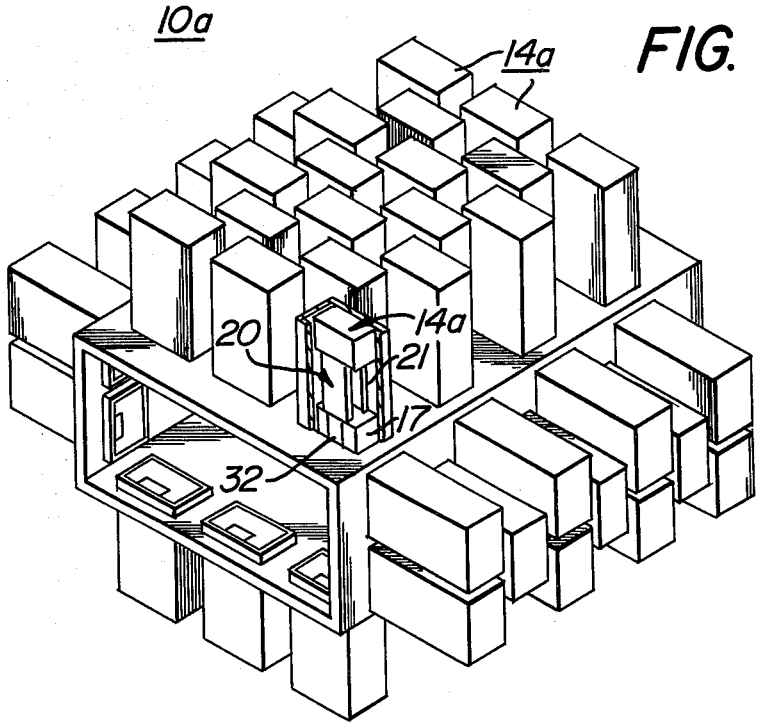
FIG. 4
FIG. 5
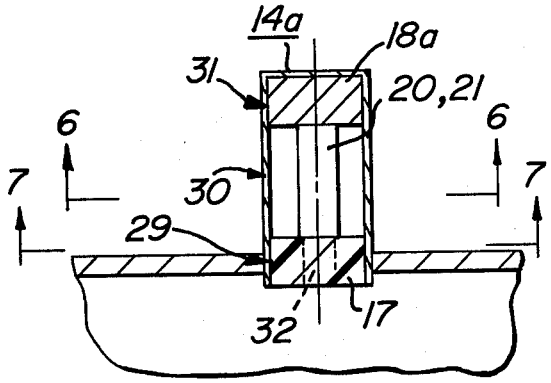
FIG. 6
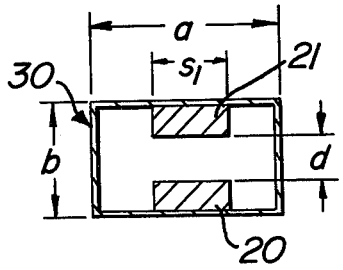
FIG. 7
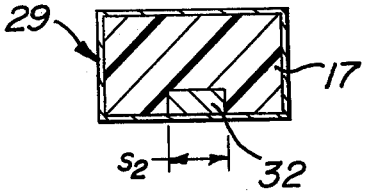

LOW PASS HARMONIC ABSORBER

BACKGROUND OF THE INVENTION

A. FIELD OF THE INVENTION

This invention relates to the field of art of microwave low-pass harmonic absorbers.

B. PRIOR ART

In radar and microwave communications, the source of microwave energy such as a magnetron, generates a desired fundamental frequency as well as considerable power at harmonic frequencies. Since only the fundamental frequency is desired, it is essential that the harmonic energy be filtered out or suppressed in the path between the source and a radiator such as an antenna. The suppression of this harmonic energy is essential to prevent the harmonics from reaching the antenna and being radiated and to prevent the harmonics from being reflected from the radiator back to the source which is undesirable.

It has been known to filter out these harmonics by a low-pass harmonic absorption filter generally descirbed in an article by Wantuch and Maines, "A Novel High Power Harmonic Suppressor," IRE Trans. G-MITT, November, 1962, pages 428–431. Such harmonic absorbers or suppressors have been nonreflective and have provided a low-loss low VSWR path for the fundamental frequency while providing an absorptive path for the harmonic energy. A rectangular main waveguide section has been sized for transmission of the fundamental with the absorptive paths provided by a plurality of cylindrical shunt waveguides coupled to the walls of the main waveguide. In a typical example 200–300 shunt waveguides may be mounted on a single main waveguide to form the harmonic absorber. In addition to cylindrical shunt waveguides, it has been known to use rectangular and honeycomb shaped shunt waveguides for the absorptive paths. The shunt waveguides have been filled with various types and shapes of dielectric material and in some cases the ends of the shunt waveguides are terminated in resistive loads. The dielectric material serves to shift the cutoff frequency of the shunt waveguide below the cutoff frequency dictated solely by the physical dimensions of the waveguide when air-filled. For a desired cutoff frequency, physically smaller shunt waveguides may be used and this reduction allows a greater number of shunt waveguides to be placed on the main waveguide.

Prior harmonic absorbers have been very costly due to the quantity of expensive dielectrics required to completely fill each of the many shunt waveguides. In addition, many of such prior shunt waveguides have required a low loss, high relative permittivity dielectric material requiring high precision machine surfaces to insure close fit between the dielectric and the wall of the waveguide. The close fit has been necessary to prevent air gaps between the dielectric and the wall which allow breakdown at high power levels. Thus, prior harmonic absorbers have left much to be desired by requiring a substantial quantity of expensive dielectric material of high dielectric constant and low loss and the need for carefully machined surfaces to insure close fit. These requirements represent the predominant costs in manufacture of the absorber since as previously described 200–300 of the shunt waveguides have been used in a typical harmonic absorber filter.

An object of the present invention is a high power loss pass harmonic absorber using ridged loaded shunt waveguides having identical cutoff frequency characteristics of dielectrically loaded waveguides of equivalent cross-section in order to duplicate the harmonic attenuation performance at considerably less expense.

Another object of the present invention is providing an "artificial" dielectric by means of ridge loading a shunt waveguide to reduce the amount of dielectric required by at least a substantial factor.

SUMMARY OF THE INVENTION

A microwave low pass harmonic absorber which comprises a main waveguide for passing a desired fundamental frequency. A plurality of shunt waveguides are disposed on at least one wall of the main waveguide. Each of the shunt waveguides includes at least one ridge for lowering the cutoff frequency of the shunt waveguide and substantially increasing the bandwidth of the shunt waveguide by lowering the standing wave ratio for the higher order harmonics.

DESCRIPTION OF THE DRAWINGS

FIG. 1 is a perspective view of a low pass harmonic absorber with a partial sectional view of one of the shunt waveguides embodying the invention;

FIG. 2 is a sectional view of a portion of the main waveguide and one of the shunt waveguides of FIG. 1;

FIG. 3 is a sectional view of the shunt waveguide of FIG. 2 taken along lines 3—3;

FIG. 4 is a perspective view of another embodiment of the invention showing a main waveguide and a partial sectional view of one of the shunt waveguides;

FIG. 5 is a sectional view of a portion of the main waveguide and one of the shunt waveguides of FIG. 4;

FIG. 6 is a sectional view of the shunt waveguide of FIG. 5 taken along lines 6—6; and FIG. 7 is a sectional view of the shunt waveguide of FIG. 5 taken along lines 7—7.

DETAILED DESCRIPTION

Referring now to FIG. 1, there is shown a low-pass harmonic absorber filter 10 which comprises a section of main waveguide 12 whose cross sectional inner dimensions are such that it propagates down the waveguide the fundamental frequency in a $TE_{10}$ mode. Coupled to all four walls of waveguide 12 are a plurality of rectangular shunt waveguides 14 which may be identical. Shunt waveguides 14 are rigidly secured to the walls of waveguide 12 and each extends through the wall as best shown in FIG. 2 in a manner known in the art. The particular placement of each of waveguides 14 is in accordance with the higher order modal E maxima distributions on the walls of the waveguide, due to the propagation of harmonics down waveguide 12. As known in the art, this placement of the shunt waveguides maximizes the absorption of the harmonics as described for example in the Wantuch and Maines article previously cited.

FIG. 2 shows in more detail one of the shunt waveguides 14 and since each of the shunt waveguides is identical only one need be described in detail. Shunt waveguide 14 comprises three sections, viz sections 24–26 which have a longitudinal dimension 23. A major portion of waveguide 14 is formed of sections 25, 26 and a major portion of section 24 extends outside of main waveguide 12 and away from the outer wall thereof. A minor portion of waveguide 14 made up of a minor portion of section 24 extends through and slightly protrudes within the inner wall of main waveguide 12. The protruding section is indicated by reference character 24a.

Section 24 is completely filled with a dielectric material 16. Thus, the protruding section 24a is formed of dielectric material 16 which extends a predetermined distance within waveguide 12. Contiguous with dielectric material 16 of section 24 is a ridged section 25. Section 25 comprises a single rectangular ridge 22 having a longitudinal dimension coincident with the longitudinal dimension 23 of waveguide 14. Ridge 22 extends within the walls of waveguide 14 and terminates in a resistive load 18 which fills upper section 26.

Instead of a harmonic absorber 10 having single ridged shunt waveguides 14, in another embodiment, a harmonic absorber 10a, FIG. 4, may have double ridged shunt waveguides 14a. Each shunt waveguide 14a may have a double ridged section 30 as shown in FIGS. 5–7. Double ridged section 30 comprises a first ridge 20 which extends between sections 29 and 31 and in addition includes a ridged section 32 which extends through dielectric material 17 of section 29. Further, section 30 includes a second ridge 21 which extends only between sections 29 and 31. It will be understood that all of the ridges in FIGS. 1–7 may be made of the same conductive material as comprise the walls of the shunt waveguides.

Theory of Operation

In the design of waveguide 14, FIGS. 1–3, it is desired that the shunt waveguide have a predetermined cutoff frequency so that it passes all frequencies above the cutoff and thereby shunt out or absorb such frequencies. By the use of dielectric section 16, a physically smaller cross sectional area waveguide 14 may be provided since dielectric 16 is effective to lower the cutoff frequency of a hollow waveguide section by the square root of the relative permittivity. Consequently, waveguide section 16, in terms of cutoff frequency, performs as though it were a much wider piece of hollow waveguide.

However, the lowering of the cutoff frequency only extends throughout the dielectrically loaded section 24. In order that the shunt waveguide propagates the maximum amount of harmonic energy to resistive load 26 with a minimum of harmonic reflection, it is necessary that the shunt waveguide have the lowest possible VSWR presented to the propagation harmonic energy. This is accomplished when the dielectric section and the ridged section have the same cutoff frequencies and the same propagation constants. The cutoff frequency of ridged section 25 is matched to that of dielectrically filled section 24 when we have the following equality.

$$\lambda_{C_{10}} \Big/ \begin{matrix}\text{dielectric}\\ \text{loaded}\\ \text{section 24}\end{matrix} = \lambda_{C_{10}} \Big/ \begin{matrix}\text{ridged}\\ \text{section 25}\end{matrix} \qquad (1)$$

For maximum propagation of harmonic energy to resistive load 26, it is also necessary to equate the propagation constant of ridged section 25 with that of dielectric section 24. If the propagation ratio is defined as the ratio of the cutoff frequency for the $TE_{20}$ mode and the $TE_{10}$ mode, then matching the propogation constants is achieved by satisfaction of equation (2), viz.

$$\frac{\lambda_{C_{10}}}{\lambda_{C_{20}}} \Big/ \begin{matrix}\text{dielectric}\\ \text{section 24}\end{matrix} = \frac{\lambda_{C_{10}}}{\lambda_{C_{20}}} \Big/ \begin{matrix}\text{ridged}\\ \text{section 25}\end{matrix} \qquad (2)$$

The propagation ratio for dielectric section 24 is equal to two but ridged section 25 has a propagation constant much greater than two. For maximum propagation (minimum reflection) of harmonic energy to resistive load 26, both equations (1) and (2) should be simultaneously satisfied.

Simultaneous solutions to equations (1) and (2) are prevented by the intrinsic difficulty in matching the real and imaginery parts of the propagation constant of the dielectric section 24 with that of single ridged section 25. Approximate solutions may be obtained by referring to the equations and figures given by Hopfer, "The Design of Ridged Waveguides", IRE trans. G-MTT, October, 1955, pages 20–29. The Hopfer article reveals the relationship between waveguide dimensions, ridged dimensions and waveguide cutoff frequencies. The article also gives the relationship between waveguide dimensions, ridged dimensions and the passband parameter.

Exact simultaneous solutions to equations (1) and (2) cannot be realized due to the impedance mismatch between sections 24 and 25. Even with this mismatch it is nevertheless advantageous to dielectrically fill a predetermined section 24 of shunt waveguide 14. For the following reasons, dielectric section 24 increases the power handling capability of shunt waveguide 14 over that of a solely ridged shunt waveguide. Additionally, the slight protrusion 24a of dielectric into main guide 12 has a superior VSWR characteristic than that effected with a slight ridged protrusion into main guide 12.

The difficulty of mismatch in the propagation constant between dielectric section 24 and ridged section 25 may be resolved by the use of a double ridged shunt waveguide 14a shown in FIGS. 4–7 where single ridged 22 is replaced by double ridges 20, 21. Dielectric section 16 is thereby replaced by a dielectric section 17 having a single ridged opening for ridge 32. An exact simultaneous solution of equations (1) and (2) can then be effected.

The insertion of a single ridge 32 into the dielectrically loaded section 29 reduces the relative permittivity of the dielectric necessary to lower the cutoff frequency of the dielectrically loaded section. A relative permittivity of four is necessary to reduce the cutoff frequency of the dielectrically loaded section by a factor of two. The same reduction in cutoff frequency can be achieved with a relative dielectric permittivitiy of only about 2.1 if a single ridge is added to the dielectrically loaded section.

The elimination of the requirement for a high relative permittivity dielectric material effects a substantial economic reduction as a relative permittivity of 2.1 can readily be achieved through the use of low cost dielectrics such as Teflon. Further, the single ridged dielectrically loaded section 29 can readily be designed to have a propagation ratio of 2.7 rather than 2.0 where 2.0 is the propagation ratio of the solidly filled rectangular cross section dielectric section 24. The higher propagation ratio allows exact solution of equations (1) and (2) which reduces the stopband VSWR to an absolute minimum.

EXAMPLE 1

In the design of an example of single ridged section 22 of shunt waveguide 14, the following are typical assumptions and design parameters in the art:

Desired passband : 2.6 - 3.5 GHz
Desired stopband : 4.2 GHz - 14.0 GHz
Main/waveguide : WR-284 (width = 3 inches)
Shunt waveguide : WR-75 (width = 0.75 inch)

The cutoff frequency for shunt waveguide WR-75 has a cutoff frequency of 7.869 GHz. Assuming an expensive dielectric such as quartz having a dielectric permittivity of 4, we have a cutoff frequency ($fc_{10}$) for the dielectrically filled section 24 shown in FIG. 1 lowered to $7.869/\sqrt{4} = 3.934$ GHz. Since there is no ridge in section 24, the propagation ratio is 2 and the $fc_{20} = fc_{10} \cdot 2 = 7.869$ GHz. The bandwidth of section 24 would be $fc_{20}/fc_{10} \sim 2.0$.

The single ridge section 25 should have a matching $fc_{10}$ of 3.934 GHz and a $fc_{20}/fc_{10}$ of 2.0. With a shunt guide with of "*a*" FIG. 3, the normal cutoff wavelength is about 1.9*a*. This can be doubled to 3.8*a* by choosing single ridge section 25 parameters of $s/a = 0.85$ and $d/b = 0.14$ from FIG. 5 of the above cited article by Hopfer. With these single ridge parameters, the single ridge section bandwidth is 2.1 as shown in the graphs of FIG. 9 of the Hopfer article and the intrinsic mismatch of the shunt waveguide scheme depicted in FIG. 1 is therefore 2.1/2.0. The dielectric section 16 should be approximately 1 inch with the total shunt waveguide section 14 being 4.1 inches for a 30db reflection of the fundamental frequency.

EXAMPLE 2

This example is for the design of sections 29, 30 of double ridged shunt waveguide 14*a*. The desired passband and stopband performance and shunt waveguide and main waveguide and main waveguide types are the same as in Example 1. However, in this Example 2, section 29 will be formed of inexpensive Teflon having a relative permittivity of 2.1.

The relative permittivity of the Teflon and the physical dimensions of ridge 32 will determine the cutoff frequency and the bandwidth of section 29. The cutoff frequency and the bandwidth of double ridged section 30 will be determined by the physical dimensions of ridges 20 and 21. It is again desired to have the $fc_{10} = 3.934$ and therefore the $\lambda_{c/a}$ (Hopfer's extension factor) for section 30 should be 3.9. Using the graph in FIG. 2 of the article by Hopfer, the double ridge dimensions $d/b = 0.125$, FIGS. 6 and 7, and $s_1/a = 0.8$ will result in a $\lambda_{c/a} = 3.9$. Thus, a bandwidth of 2.7 may be calculated for the double ridge dimensions in Example 2.

For the same cutoff frequency and bandwidth with a relative permittivity of 2.1, the dimensions of the dielectrically loaded single ridge section 29 may be computed to be $d/b = 0.37$ and $s_2/a = 0.22$.

In actual practice, an interactive computer program using Rosen's gradient-projection method for constrained optimization would be very beneficial in calculating the physical dimensions of the double ridge and the single ridge.

What is claimed is:

1. A microwave low-pass harmonic absorber comprising:

a main waveguide for passing a desired fundamental frequency, and a plurality of shunt waveguides disposed on at least one wall of said main waveguide, each of said shunt waveguides including at least one ridge for lowering the cut-off frequency of said shunt waveguide and substantially increasing the bandwidth of said shunt waveguide by lowering the standing wave ratio for the higher order harmonics.

2. The harmonic absorber of claim 1 in which said main waveguide is effective to pass a desired fundamental frequency of narrow bandwidth and for each shunt waveguide said ridge is disposed on a wall of said waveguide and forming a ridged section.

3. The harmonic absorber of claim 2 in which for each shunt waveguide there is provided a dielectric section having substantially the same cut-off characteristics of said ridged section and disposed at the end of said shunt waveguide adjacent said main waveguide.

4. The harmonic absorber of claim 3 in which for each shunt waveguide said ridged section contacts said dielectric section thereby to better couple the harmonic energy from said main waveguide into said shunt waveguide.

5. The harmonic absorber of claim 2 in which said ridged section includes two ridges disposed opposite each other.

6. A microwave low-pass harmonic absorber comprising:

a main waveguide for passing a desired fundamental frequency, a plurality of shunt waveguides disposed on at least one wall of said main waveguide, each of said shunt waveguides including at least one ridged section for lowering the cut-off frequency of said shunt waveguide, and each shunt waveguide including a dielectric section having substantially the same cut-off characteristics of said ridged section and said ridged section contacting said dielectric section thereby to better couple the harmonic energy from said main waveguide into said shunt waveguide.

7. The harmonic absorber of claim 6 in which said ridged section includes two ridges disposed opposite each other.

8. The harmonic absorber of claim 7 in which one of said two ridges extends within said dielectric section to provide a better impedance match between said dielectric section and said ridged section.

9. The harmonic absorber of claim 8 in which there is provided a resistive load section contacting said ridged sections and disposed at an end of said shunt waveguide remote from said dielectric section.

* * * * *